US005115613A

United States Patent [19]

McCarthy

[11] Patent Number: 5,115,613

[45] Date of Patent: May 26, 1992

[54] THETA BLAST CELL

[75] Inventor: Walton McCarthy, Concord, N.H.

[73] Assignee: Theta Technologies, Inc., Concord, N.H.

[21] Appl. No.: 306,419

[22] Filed: Feb. 6, 1989

[51] Int. Cl.[5] ..... E02D 27/00

[52] U.S. Cl. ..... 52/169.6; 109/1 S

[58] Field of Search ..... 52/169.6, 173; 109/1 S; 220/4 B, 4.21, 4.24

[56] References Cited

U.S. PATENT DOCUMENTS

| | | | |
|---|---|---|---|
| 752,259 | 2/1904 | Purdy | 52/184 |
| 2,920,682 | 1/1960 | Lindberg | 220/4 B |
| 2,968,130 | 1/1961 | Bascom | 52/169.6 |
| 3,138,124 | 6/1964 | Baier | 109/1 S |
| 4,660,334 | 4/1987 | McCarthy | 285/224 |

FOREIGN PATENT DOCUMENTS

| | | | |
|---|---|---|---|
| 1125175 | 7/1956 | France | 220/5 A |

*Primary Examiner*—James L. Ridgill, Jr.
*Attorney, Agent, or Firm*—Christensen, O'Connor, Johnson & Kindness

[57] ABSTRACT

An underground blast shelter providing short and long term protection against nuclear detonation for its occupants. The shelter consists of a paraboloidal cell to house the occupants and a command station interfacing with the ground surface. A flange completely surrounds the cell along its long dimension. The command station is made from an upper portion made out of steel and a lower portion which is a part of the flange of the cell. Access between the command station and the cell is through the flange and includes foot wells to facilitate movement.

20 Claims, 6 Drawing Sheets

THETA BLAST CELL

BACKGROUND OF THE INVENTION

This invention relates to a blast shelter and more particularly to a personal blast shelter capable of providing improved protection during and after the detonation of nuclear weapons and other disasters.

In my U.S. Pat. No. 4,660,334 issued on Apr. 28, 1987 I describe such a shelter capable of producing survival for its occupants during and after one or more nuclear blasts regardless of where detonation takes place except if the shelter is within or close to the crater formed by a surface blast. Such a shelter is capable of withstanding large doses of neutron and gamma radiation, ground shock, and substantial over pressures, as well as a variety of other conditions, both short and long term, enumerated in my patent.

SUMMARY OF THE INVENTION

In the present invention substantial improvements have been made in the blast shelter described in my patent identified above.

In order to increase the ability of the containment to resist the blast effect resulting from the detonation of a nuclear device, the shape has been changed and the construction of the connecting shaft below the command station has been improved in the ability of the system to absorb the downward forces on the command station. In addition, the shelter has been rendered more compact and less expensive to manufacture and install.

The present invention will protect a family unit, that is, shelterists, during disasters such as tornadoes, storms, forest fires, power failures, nuclear power plant accidents, nuclear terrorism, and a full scale protracted nuclear, chemical, and biological war.

A number of other improvements have also been made to render the present invention the next generation of blast shelters of this type.

It is therefore a principal object of this invention to provide an improved and more compact nuclear blast shelter.

Other objects and advantages of this invention will hereinafter become obvious from the following detailed description of a preferred embodiment of this invention.

DETAILED DESCRIPTION OF THE PREFERRED EMBODIMENT

Figure 1:
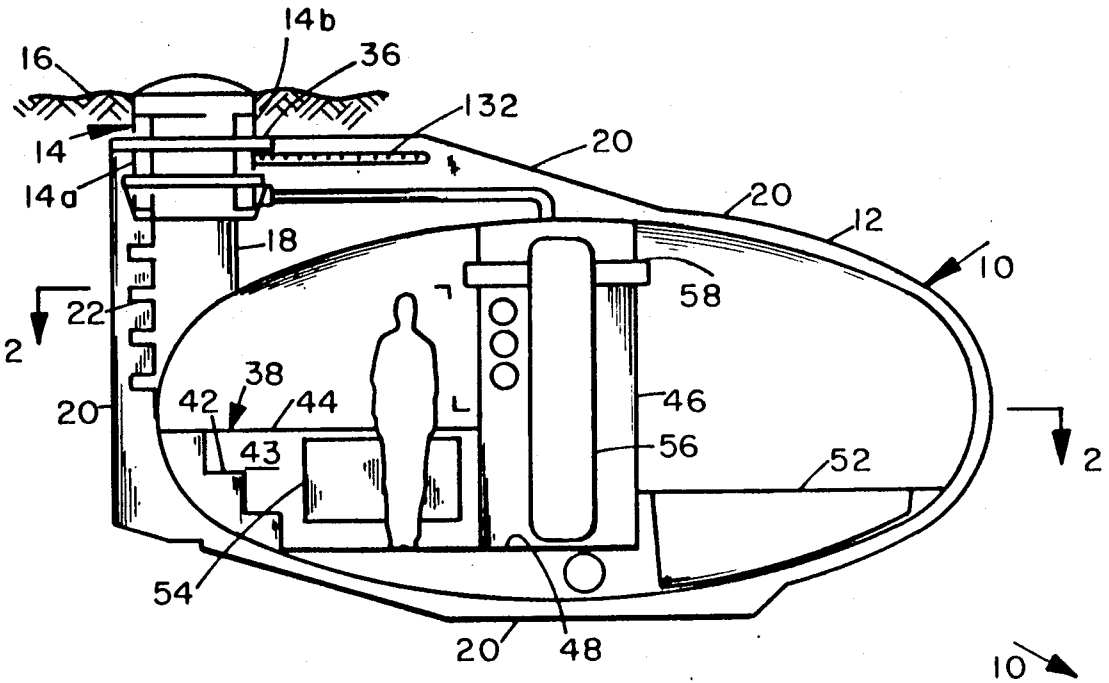
FIG. 1 is an elevation view in section partially illustrative of a shelter in place constructed in accordance with the principles of this invention.
Figure 2:
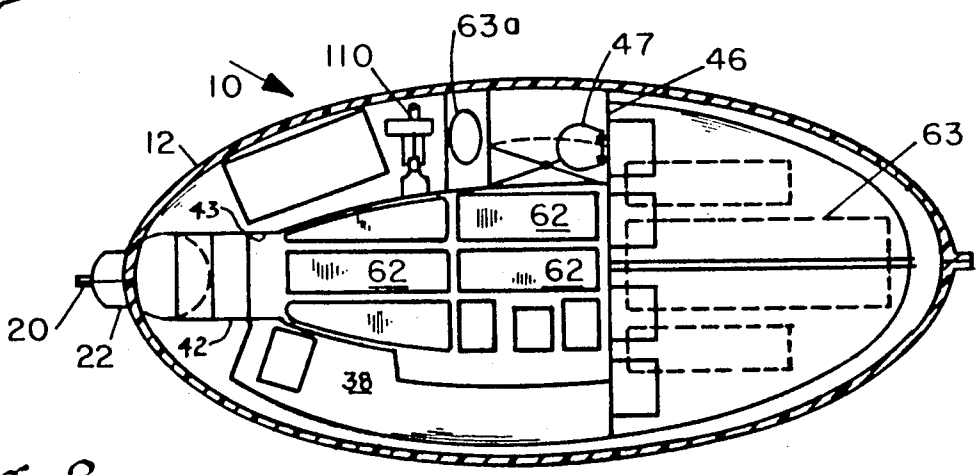
FIG. 2 is a partially illustrative plan view of the shelter taken along 2—2 of FIG. 1.
Figure 3:
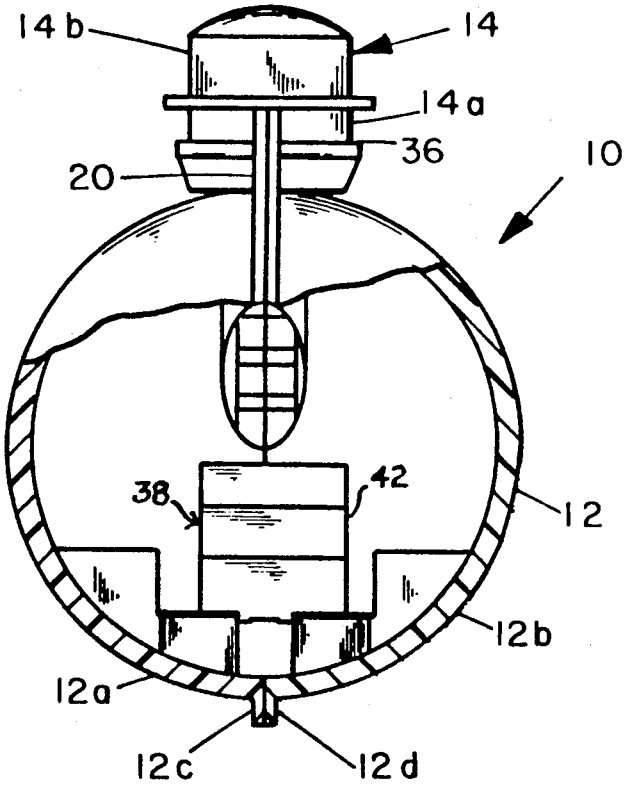
FIG. 3 is a right side view the shelter of FIG. 1 partially cut away.

Referring to FIGS. 1, 2, and 3, there is shown a blast shelter 10 consisting of a cell or containment 12 of paraboloidal configuration, a command station 14 interfacing with ground level 16, and a passageway 18 for providing communication between cell 12 and command station 14.

Cell 12, which is made from fiberglass, is of clam shell construction consisting of two clams shells 12*a* and 12*b* having rims 12*c* and 12*d* which are joined to form a flange 20 completely surrounding cell 12 in its long dimension. When the two clam shells 12*a* and 12*b* are placed together as illustrated, the two rims 12*c* and 12*d* are bonded and bolted together forming a fully enclosed unit with flange 20 covering the whole perimeter of shelter 10 in its long dimension. By fiberglass herein is meant fiberglass reinforced plastic (FRP) which is commercially available and typically is used to form the hulls of boats.

Each of the shells 12*a* and 12*b* includes one half of passageway 18 with molded foot wells 22 formed to be used as steps to climb up passageway 18. Since the diameter of passageway 18 is only about two feet, the opposite side of passageway 18 from foot wells 22 provides needed support for the climber.

Command station 14 consists of its lower part 14*a* which is an integral part of clam shells 12*a* and 12*b* and thus is formed from two oppositely facing parts, and is part of the fiberglass construction of cell 12, and an upper part 14*b* which comprises a cylindrical body made from steel.

Figure 4:
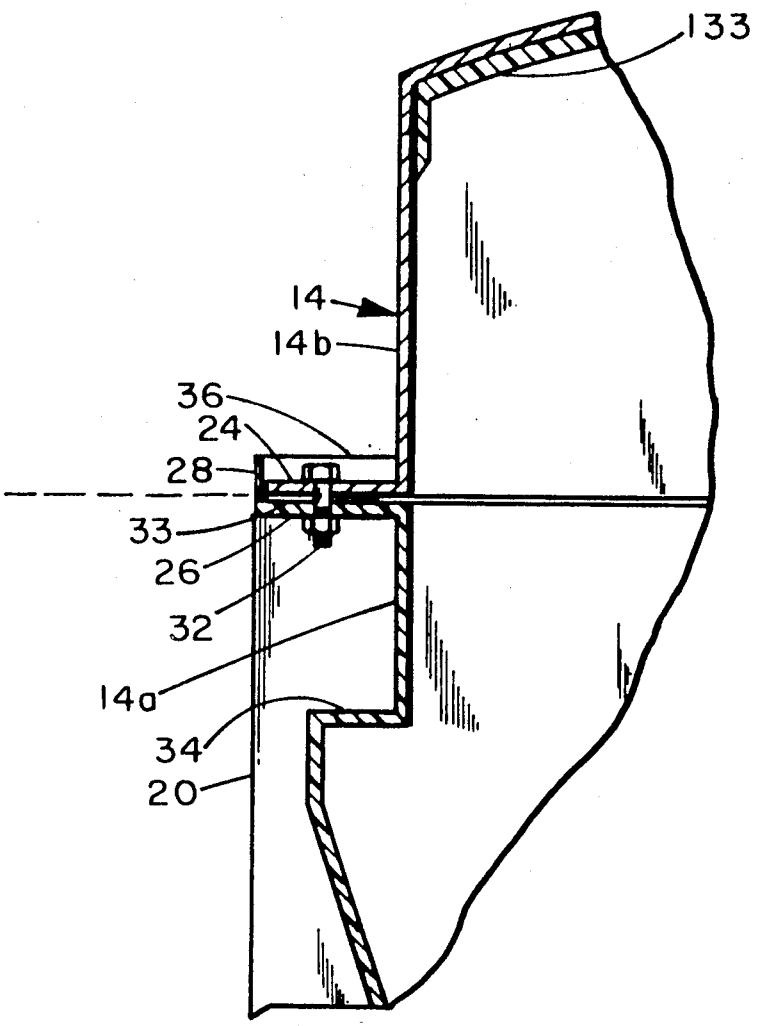
FIG. 4 is a detail in section of the left side of the command station shown in FIG. 1.

For details of how command station 14 is constructed in this manner, reference is made to FIG. 4. The upper part 14*b* of command station 14 consists of a cylindrical section of steel the bottom part of which terminates in a rim 24. The lower part 14*a* of command station 14 terminates at the top in a rim 26 having an upwardly extending lip 28. A plurality of annularly arranged bolts 32 through rims 24 and 26 hold the upper and lower portions of command station 14 together. A gasket 33 is employed between the two rims. As previously noted, since lower part 14*a* is part of flange 20 surrounding cell 12, part 14*a* comes in two oppositely facing sections which come together to form the lower half of command station 14 when clam shells 12*a* and 12*b* are joined together.

It will be noted that the lower part 14*a* of station 14 is provided with a shoulder 34 which flexes to absorb any forces transmitted from ground level through command station 14 to cell 12. Shoulder 34 is joined to a flared section which is illustrated. In addition, the fiberglass construction of the lower half of passageway 18 helps to absorb these forces due to the ability of the material to flex.

The inside of upper part 14*b* of command station 14 is covered with a layer 133 of high temperature thermal insulation material to prevent excessive heat from building up inside the command station during a sustained fire. The shelter itself is protected against this heat by the earth on top of the shelter. A sustained fire could develop when a house collapses on the shelter and burns. The shelter is designed to resist fire reaching 1500 degrees F. during a three hour period. During this time the shelter must be operated in a sealed shelter atmosphere.

It should be noted from FIGS. 1 and 4 that the construction of shelter 10 extending down from the top of flange 20 is all fiberglass while the portion of shelter 10 extending from flange 24, namely, the upper part of command station 14 is steel. This construction maximizes strength and economy of manufacture and assembly.

Within shelter 10, referring to FIGS. 1-3, there is provided a unitary structure 38 of fiberglass construction which includes stairs 42, a cabinet 43 having a counter top 44, a bathroom 46 with a hand pumped toilet 47, and floors 48 and 52. The cabinet below top 44 and bathroom 46 are provided with access openings 54 and 56, respectively. Bathroom 46 is provided with shelving 58 to accommodate candles and the like. Floors 48 and 52 are provided with a number of trap doors 62 which are lifted to gain access to storage areas under the floors.

Unitary structure 38 is of single piece fiberglass construction which is inserted between clam shells 12*a* and 12*b* just before they are assembled and bonded and bolted together at their rims 12*c* and 12*d*.

Water tank 63 of shelter 10 is located under floor 52 at the far end of the shelter. The interior sides of tank 63 would have level markers to indicate volume in gallons which have been consumed and gallons remaining in the tank.

Water is piped from tank 63 to sink 63*a* through a flexible hose (not shown). A manual faucet/pump (not shown) would be located on sink 63*a*.

Tank 63 is filled with water and chlorinated when shelter 10 is installed and can be stored for one year. The chlorine keeps bacteria and algae from growing. The water is not potable (fit for drinking), however until it is properly filtered.

Because water tank 63 is below the frost level, it will not freeze. Once a year the water must be replaced so that the shelter will always be ready for immediate use in case of an emergency. Included in the shelter is an electric pump (not shown) which is capable of lifting the water from the water tank 63 to the ground surface. Although the water in the tank is very cold and chlorinated, some invisible bacteria may develop if not properly chlorinated making the interior walls slimy to the touch. If this develops the water tank walls can be cleaned through the water tank cover when the water is changed each year.

Filling the water tank during wartime or when there is no electricity would be accomplished by siphoning water through a hose from a jug or bucket on the surface down the shelter entranceway through a water filter to remove particulates and/or radioactive fallout and into the water tank.

Referring to FIGS. 5, 6, 7, and 8, it will be noted that the top of command station 14 is dome shaped and provided with a cover 64 of smaller diameter having an extension 66 which is hinged on a pin 68 through an elongated slot 70 for a purpose to be described below. It will be noted that the rim of cover 64 is provided with a lip 72 which engages a shelf 74 having a shoulder 76 of annular configuration. A flange 75 at ground level provides additional stability.

Adjacent extension 66 is a threaded opening 78 into which is threaded an external lock member 82 having an opening 83 for a padlock (not shown). Lock member 82 with its padlock would be employed when shelter 10 is unoccupied to prevent unauthorized entry. Member 82 prevents cover 64 from being opened by blocking the pivoting of extension 66. The padlock when installed would prevent rotation and removal of member 82. Removal of lock member 82 permits access into shelter 10.

Figure 6:
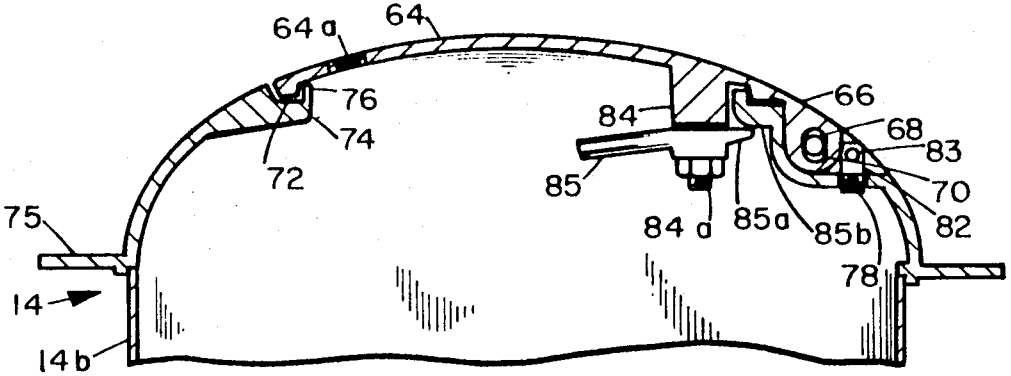
FIG. 6 is a view along 6—6 of FIG. 5.

Referring particularly to FIG. 6, adjacent the hinge arrangement just described is a dog mount 84 with a threaded extension 84*a* on which is mounted a dog 85 to tighten cover 64 down when closed from the inside. Dog 85 has an extension 85*a* riding on a wedge 85*b*. When dog 85 is rotated, cover 64 is clamped down. Slot 70 is elongated in order to permit this tightening to take place. Several dog mounts may be employed.

One or more threaded openings 64*a* are provided in cover 64 to form light ports. A sight glass or a plug would be threaded into each opening 64*a*, as required, and, also, any one of these openings can be used to extend a radio antenna.

During daylight hours, sunlight is piped into the shelter through light ports 64*a* and reflected into the shelter. White glossy walls of the shelter provide ample brightness from this light.

Shelter use during wartime must depend on light other than daylight because there may be only 10 percent of the normal daylight during the first week and reduced light levels during the first month from the injection of smoke and soot into the atmosphere.

Figure 7:
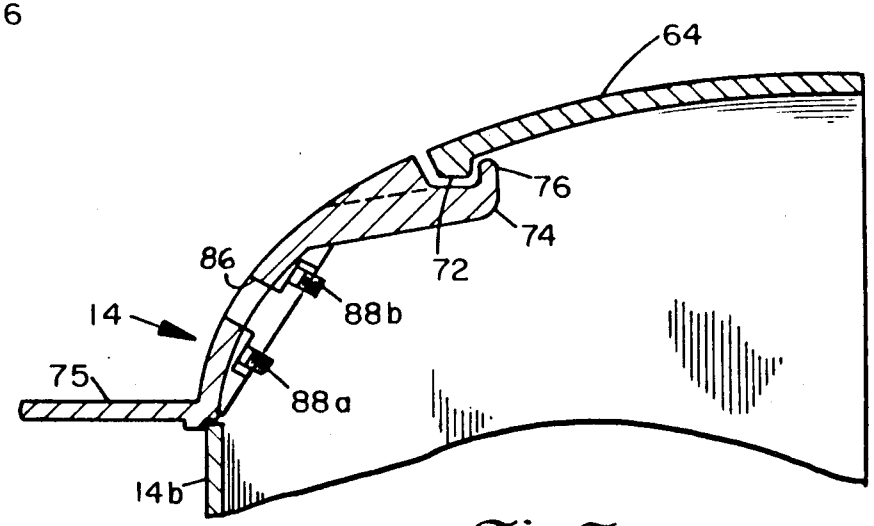
FIG. 7 is a view along 7—7 of FIG. 5.
Figure 5:
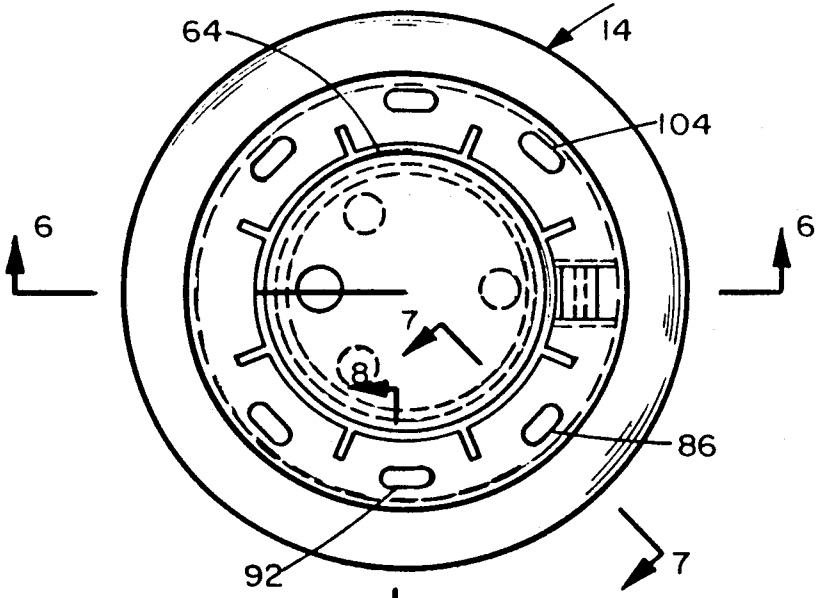
FIG. 5 is a top view of the command station shown in FIG. 1.

As seen in FIGS. 5 and 7, there are provided one or more elongated slots 86, as defense ports, each covered by a plate (not shown) which would be screwed on over the opening from the inside using bolts 88*a* and 88*b*.

Figure 8:
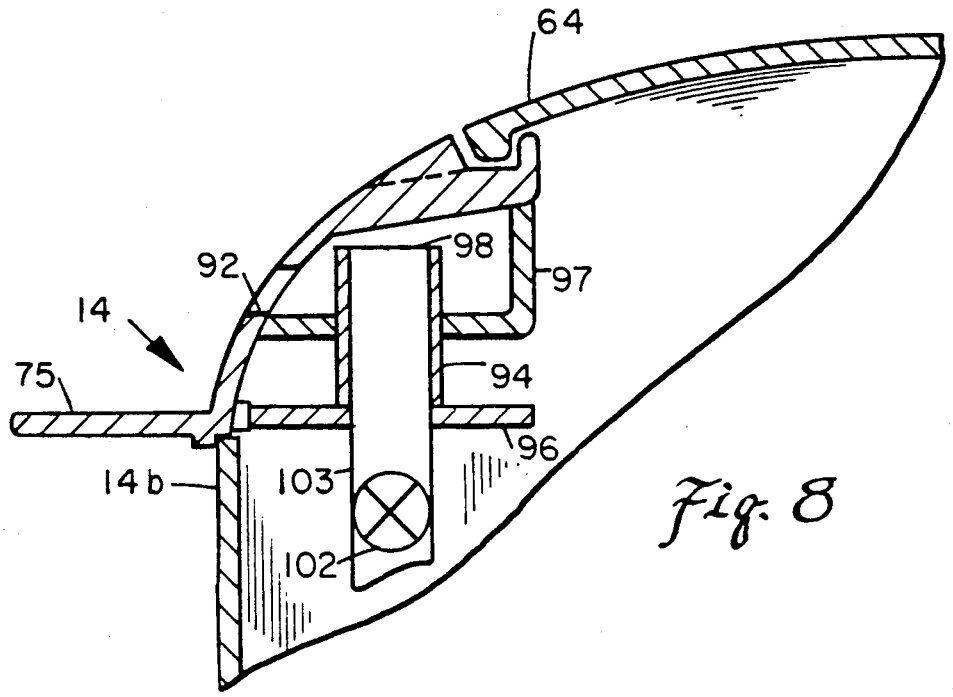
FIG. 8 is a view along 8—8 of FIG. 5.

As seen in FIGS. 5 and 8, there is also provided an air intake port 92. Within command station 14 there is provided an upwardly extending pipe 94 mounted on a pipe flange 96 and supported by an angle 97. Pipe 94 terminates at 98 above the level of port 92. This is to prevent any water entering port 92 from running into pipe 94. In the event of a massive flow of water, pipe 98 would be sealed off as will be described below. A blast valve 102 is located within a conduit 103 which receives the air from port 92 and pipe 94. Valve 102 closes in the event air pressure rises above some threshold value, thereby blocking any blast wave from entering the shelter, or in the event water enters pipe 94. For exhaust port 104 there would be provided a blast valve (not shown) which is a simple check valve to permit air to be discharged but not to enter.

Figure 8B:
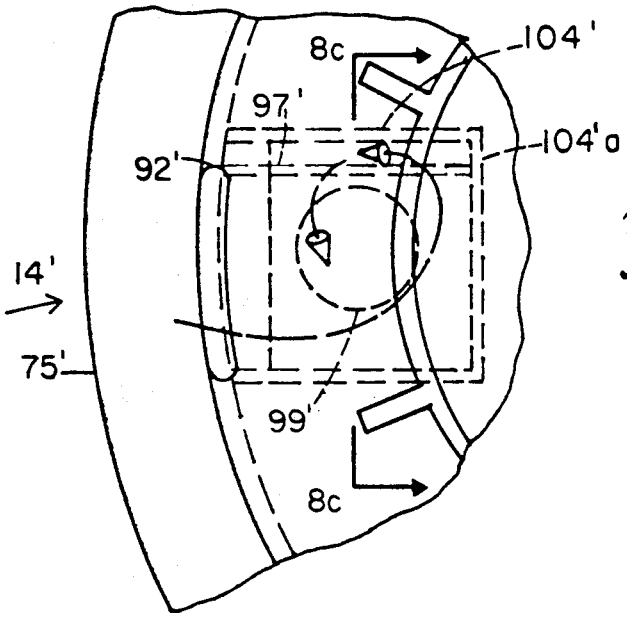
FIG. 8*b* is a top view of the arrangement shown in FIG. 8*a*.
Figure 8A:
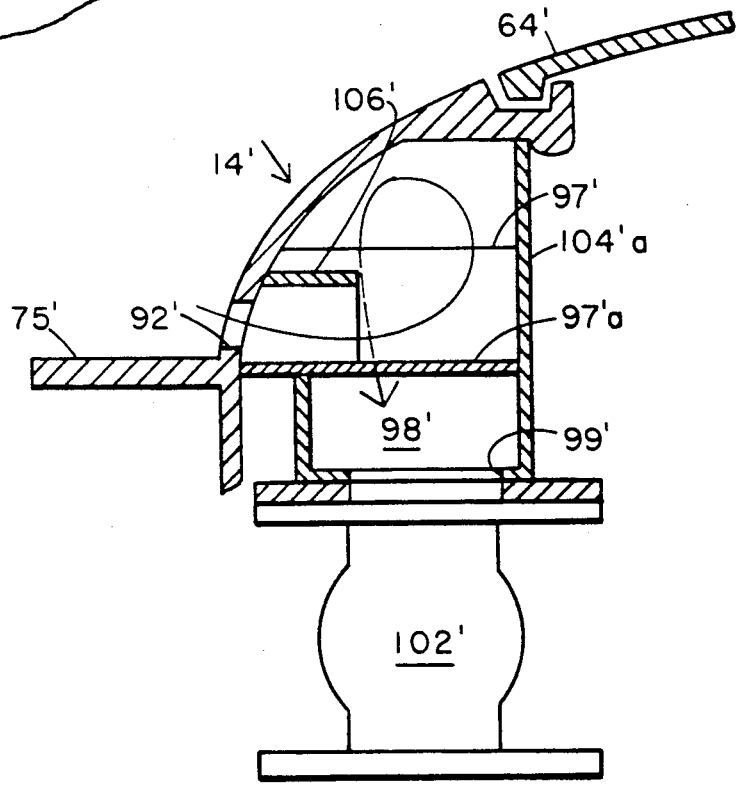
FIG. 8*a* is a view similar to that of FIG. 8 showing an alternative embodiment of the air input for the ventilation system, partially schematic.
Figure 8C:
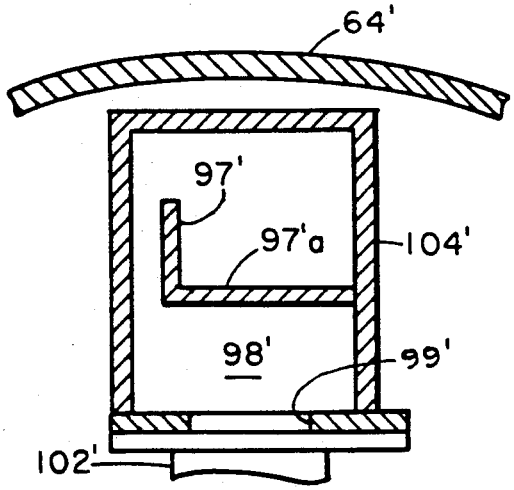
FIG. 8*c* is a view, partially schematic, along 8*c*-8*c* of FIG. 8*b*.

An alternative air intake arrangement with reduced resistance to air flow is shown in FIGS. 8*a*, 8*b*, and 8*c*. Command station 14' otherwise identical to station 14 described in the previous figures is provided with an inlet port 92' located just above flange 75'. An angle 97' with a horizontal leg 97'*a* causes the incoming air as shown by the arrows in FIGS. 8*a* and 8*b* to enter horizontally, rise to go over the vertically extending side of angle 97' and then flow down into a region 98' having an opening 99' into blast valve 102' shown schematically. The region is boxed in with a U-shaped member 104 having an end wall 104'*a*. A section of an angle 106' directs the air into the region.

Figure 9:
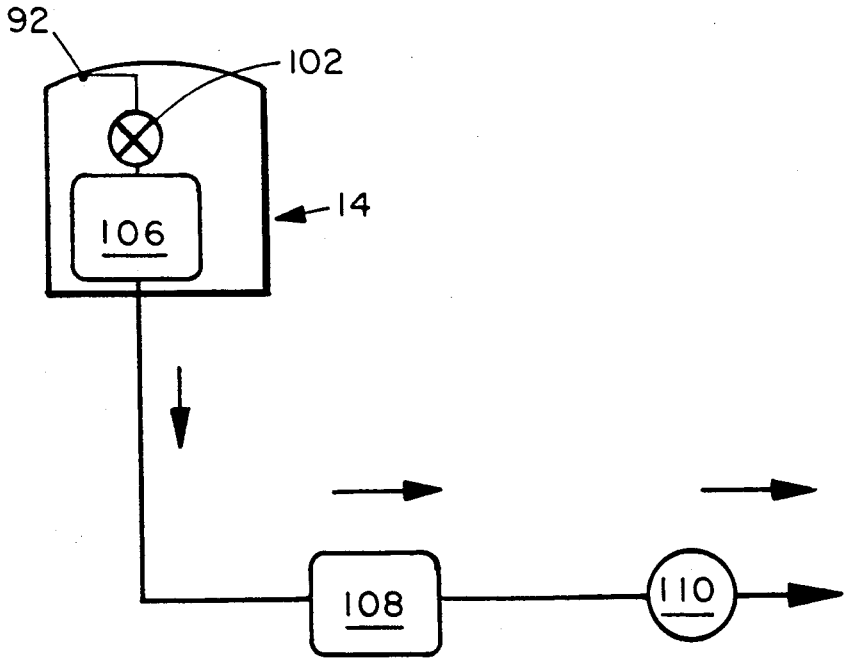
FIG. 9 is a schematic of the air infiltration system.

A schematic of the air infiltration system is shown in FIG. 9. There it will be seen that within command station 14 is shown blast valve 102 located adjacent opening 92 and a filter 106. Within cell 12 there is located a carbon filter 108 and a blower 110 which would be manually operated. Carbon filter 108 and blower 110 are located within cell 12 with filter 108 typically on a counter top. Since filter 106 traps radioactive particulates, it must remain in the command station. Filter 106 is a simple mechanical filter consisting of a cloth bag made of ordinary felt to trap particulates.

Figure 10:
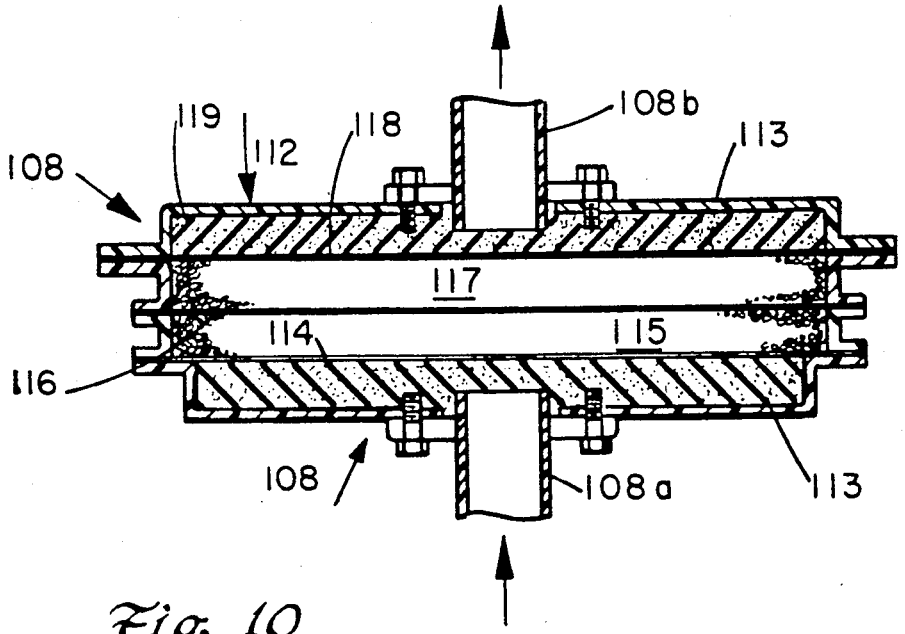
FIG. 10 is a section through the carbon filter shown in FIG. 9.

Cross sectional details of filter 108 are shown in FIG. 10. Filter 108 comprises a fiberglass housing 112 containing a layer of open-celled foam 113 on the bottom (upstream side) of housing 112, a first filter cloth 114 located above foam 113, a layer of carbon particulate 115 supporting a first filter cloth 114, and a second filter cloth 116 located above carbon particulate 115 which fills the space between filters 114 and 116. Above and supported by filter cloth 116 is another layer of carbon particulate 117 filling the space up to a third filter cloth 118 located just above particulate 117. Finally, a second layer of open-celled foam 119 fills out the interior of housing 112.

The purpose of foam 113 is to prevent distortion of the filter cloths due to the weight of the materials, especially when there is no air flow. Cloth 114 primarily supports the carbon particulate 115 but will also catch any particulate missed by filter 106. Carbon particulate 115 consists of activated carbon to remove any radioactive iodine gas which may be present.

Carbon particulate 117 consists of carbon particles impregnated to absorb gaseous contaminates and specific toxins related to chemical warfare. Such material is available commercially.

Filter cloth 116 separating the two layers of carbon prevents their becoming intermixed.

Filter cloth 118 prevents carbon fines from being introduced into the shelter while foam 119 prevents cloth 119 from stretching out and permitting the carbon particulate upstream from piling up in the center.

The open celled foam materials 113 and 119 are ordinary polyvinylchloride (PVC) having an epoxy coating to provide stiffness and strength and such material is available commercially.

Air blower 110 is operated by a hand crank and will deliver enough air volume to completely replace all the air in the shelter in approximately 6 minutes. To meet the breathing requirements air blower 110 has to be operated only 10 minutes per hour per 5 adults.

If too little fresh air is pumped into the shelter the carbon dioxide levels will reach 3% in about 6 hours with 5 adults in the shelter. At this level the shelterists may experience headaches. To prevent this from happening a clock would be employed to remind the shelterists that the air blower has to be operated. There could be small streamers on the outlet of the fan to confirm air being pumped into the shelter. Should the air blower not be operated for longer than approximately 6 hours, for example, during sleeping periods, the shelterists may wake up with a headache.

When there is an extensive fire directly on top of the shelter, superheated air from outside must not be pumped into the shelter by operating air blower 110. The shelterists must then live in the shelter without fresh air coming into the shelter. This is called operating in a sealed shelter atmosphere.

Most fires have a violent burning period up to about one hour and are totally over in about three. The present blast cell has enough volume of air to support 5 adults for a period of 6 hours when operating in a sealed shelter atmosphere. There is no need for synthetic air during this period. To enable the shelterists to monitor the internal temperature of the shelter a thermometer may be provided.

Figure 11:
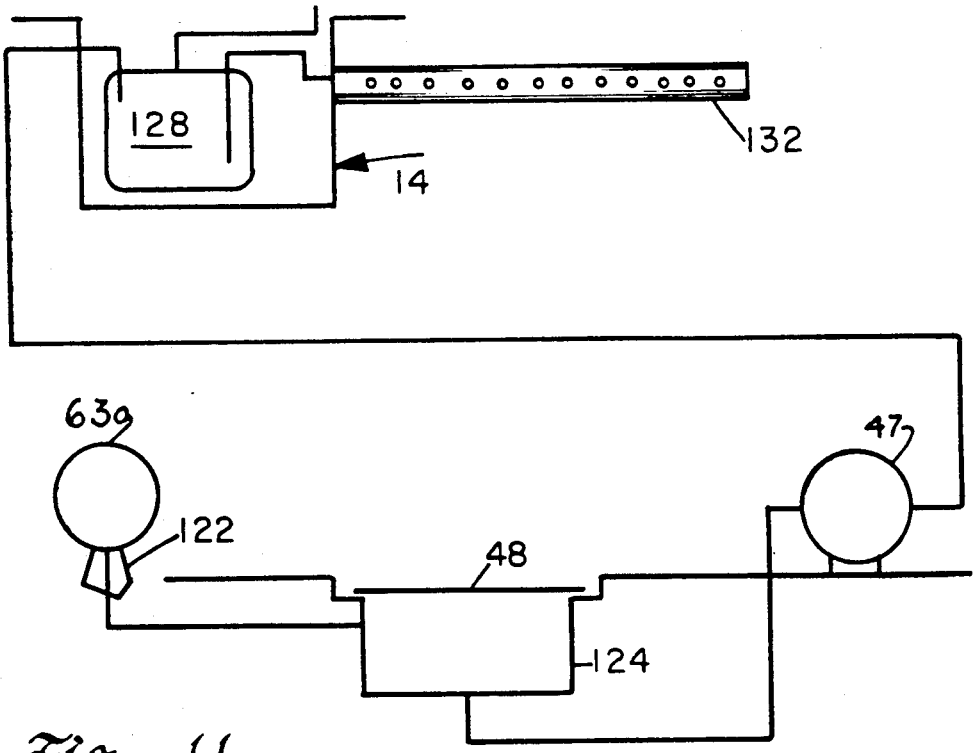
FIG. 11 is a schematic of the plumbing system.

Shelter 10 is provided with a system to dispose of liquid wastes, and the schematic is shown in FIG. 11.

Gray water, that is, water used in washing and showering, is collected in sink 63*a* and by gravity passing through a filter bag 122 to collect solid wastes and is delivered to a holding tank 124 located beneath floor 48. Water from tank 124 is hand pumped for use in toilet 47 and hand pumped up to a septic tank 128 located in command station 14 in which the solids settle out to the bottom. As tank 128 fills up the liquid passes out into the leach field surrounding station 14 through one or more perforated pipes 132. Suitable venting through one of the openings in cover 64 may be provided, each opening being provided with a screw on cover in case required.

At least one person each day must take a shower to provide enough gray water in the gray water holding tank 124 to flush toilet 47. Gray water is water which is contaminated from washing dishes and bathing but not sewage. Showering in the shelter is very basic. A two gallon tank (not shown) is filled from the faucet in sink 63*a*. The tank with the filtered water is hung on the cowling within bathroom 46 and the shelterist uses a hose from this tank to direct water over the body. The shower water drains down into the gray water holding tank 124 where it will be used to flush toilet 47.

The gray water in holding tank 124 is not potable. This system allows a much smaller water supply rather than wasting potable water to flush the toilet. The toilet has a small hand pump (not shown) which provides the force to push the sewage up to the septic tank. The sewage hose is completely accessible and is connected to the septic tank in command station 14.

Septic tank 128 has a volume of 10 gallons and proportionately conforms to standard building codes which allows the water portion of the sewage to drain off and the poisonous gases which develop from decomposition to vent to the outside through one of the ports in the top of command station 14. The sanitation system in shelter 10 is designed to last one month before it will require dumping. When septic tank 128 is full, it is taken outside through the command station hatch where the septic tank cover is removed and then dumped.

The blast shelter would be supplied with long life candles, typically each having a burning time of 150 hours. This is a simple, safe and efficient way of lighting. In common building structures where the walls are flat, high, and have a rough surface texture, a candle is not adequate. However, in the present shelter, the walls are curved, white, and smooth resulting in a simple candle providing adequate light.

The invention as described above, in a typical size, is a totally self contained, paraboloid nuclear blast shelter designed for five adults to be personally owned by a single family. It can be installed above or below the water table and does not require electricity to operate. As noted, the shelter is made of structural fiberglass and steel. The inside is smooth and white to create maximum brightness with minimal light. It has its own air filtration system, water supply, septic system, light, sleeping area, exercise area, and storage area, all of which will function without electricity. These facilities are all provided for in a sterile environment and the shelter can be installed in almost any part of the world.

Cell 12 is a fiberglass structure composed of multiple compound curves. Fiberglass is chosen as the optimum material because of its characteristics for a blast resistant structure placed below ground. A fiberglass structure is completely watertight and proven to be sound in the boat and underground storage tank industries. In addition, one of the greatest characteristics of fiberglass is it resiliency. It can be overstressed and return to its normal shape with no structural damage and has a life span of hundreds of years. It can also be repaired very easily by the owner. A fiberglass structure can be designed with multiple compound curves on all three axis making it extremely strong.

Cell 12 in effect is a pressure vessel designed for external pressure, not internal pressure. A structure which is round and placed under internal pressure like a pipe will maintain its shape, but a structure which is placed under external pressure tends to lose its shape and therefore its structural integrity unless it is designed specifically for external loading subject to buckling. In the present invention the pressure vessel is subject to external pressure rather then internal pressures.

Shelter 10 would come with a survey meter to measure the radiation rate. For shelters which are directly downwind of ground zero, 94% of the total radiation will have decayed after the first week and 99% will have decayed by the 28th day. After the 28th day the radiation levels are near normal levels and normal living can resume including functions such as dumping sewage. The actual time will probably be less and will depend on the size of weapon, type of burst, height of burst, weather, and terrain. A survey meter available within the shelter enables the shelterists to determine the actual radiation level and thus determine how long they will have to stay in the shelter. During this 28 day period, shelterists can come out of the shelter for brief periods to make radiation measurements and otherwise examine the state of the environment.

The absence of chemical and biological warfare agents and enemy infantry should be verified before leaving the shelter. This can be accomplished in two ways. The first way is listening to emergency radio broadcast stations reporting the location of the enemy and types of tactical weapons being used. The radio in the shelter would be powered by a small battery. The blast shelter battery operated AM, FM, Short wave radio allows the shelterist to listen to broadcasts on frequency bands in the U.S. and other countries. To use the radio it is necessary to stick the radio antenna out of a defense port of the command station.

The second way is to look through the view ports to verify animal life such as birds, dogs, cats, etc. All animals should be observed for at least 24 hours.

Heating in the shelter is provided by the heat loss of the shelterists. The shelter being in the earth is much more stable during outside temperature fluctuations than in an above ground structure. Heating is rarely a problem in an underground structure. For this reason the blast shelter has no insulation.

Cooling in the shelter is provided by a greater volume of air being pumped into the shelter. The exhausted air is also removed at the top of the shelter. Air blower 110 should be capable of supplying 20 cubic feet per minute for each shelterist which will allow a maximum internal temperature of 75 degrees F. not accounting for the mass of the surrounding earth. With the volume of the shelter being so large and so much earth covering the shelter, the inside temperatures would be quite comfortable. This particular engineering design eliminates the typical problem of the shelter overheating.

While only preferred embodiments of this invention have been described it is understood that many variations of the invention are possible without departing from the principles of this invention as designed in the claims which follow.

What is claimed is:

1. An underground nuclear blast shelter comprising:

a. elongated cell means below ground level containing living space for one or more occupants of said shelter;

b. underground command station means located above one end of said cell means having a dome at ground surface and passageway means extending directly down into the cell means for providing access through the bottom of said command station means to said cell means, said dome being the only visible portion of said shelter;

c. said cell means comprising a pair of matching elongated clam shaped elements having matching rims extending along the edges thereof, said matching rims bonded to each other to form a flange completely encompassing said cell means along the long dimension thereof;

d. said command station means comprising a lower portion formed within and being an integral part of said flange formed by said clam shaped elements, said flange extending above the cell means, and an upper portion extending above said flange, means joining said upper and lower portions of said command station means to form an enclosed area; and e. said passageway within and being an integral part of said flange formed by said clam shaped elements to provide said communication between said command station means and said cell means.

2. The shelter of claim 1 wherein said cell means is paraboloidal in configuration.

3. The shelter of claim 1 wherein said command station means includes conduit means extending out from said upper portion for distributing liquid waste products into a surrounding leach field formed below ground level.

4. The shelter of claim 1 wherein said command station includes means within said lower portion for absorbing vertical faces on said dome.

5. The shelter of claim 1 in which said dome includes air inlet and outlet openings, a light port, and a defense port.

6. The shelter of claim 1 in which the inner surface of the upper portion of said command station means is lined with fire insulation.

7. The shelter of claim 1 in which the inner surface of said cell means is smooth, curved, and painted white to make most effective use of a small source of light.

8. The shelter of claim 1 wherein said cell means including said flange and the lower portion of said command station means are concentrated out of fiberglass.

9. The shelter of claim 8 wherein the upper portion of said command station means is metallic in construction, said joining means comprising matching rims in said upper and lower portions for joining said portions together, said command station means thereby being a composite of fiberglass and metal.

10. The shelter of claim 1 in which said passageway means includes foot walls formed within said flange by said clam shaped elements to facilitate movement between said cell means and said command station means.

11. The shelter of claim 10 having unitary structure means for mounting between said clam shaped elements during assembly to form said cell means, said structure means including steps for permitting said occupants to climb sufficiently high to make contact with said foot walls.

12. The shelter of claim 1 in which the upper portion of said command station means includes ventilation means for taking in fresh air and means for discharging exhaust air.

13. The shelter of claim 12 having means to block water seepage into said command station means.

14. The shelter of claim 12 in which said ventilation means includes valve means to prevent blast waves from entering said shelter.

15. The shelter of claim 14 in which said ventilation means includes first filter means within said command station means to trap particulates in incoming fresh air and second filter means within said cell means to remove from said fresh air detrimental gaseous components from said fresh air.

16. The shelter of claim 15 in which said second filter means comprises a first bed of activated carbon means to remove any radioactive particulate not trapped by said first filter means and a second bed of carbon means to absorb gaseous contaminants related to chemical warfare.

17. The shelter of claim 16 having a first filter cloth to separate the two beds of carbon to prevent intermingling.

18. The shelter of claim 17 having a second filter cloth upstream of said carbon means to support the adjacent carbon means.

19. The shelter of claim 18 having a third filter cloth downstream of said carbon means to trap carbon fines.

20. The shelter of claim 19 having open celled foam means both upstream of said second filter cloth and downstream of said third filter cloth to prevent distortion of said filter cloths and redistribution of said carbon means, said open celled means being coated with an epoxy to provide stiffness.

* * * * *

UNITED STATES PATENT AND TRADEMARK OFFICE

CERTIFICATE OF CORRECTION

PATENT NO. : 5,115,613

DATED : May 26, 1992

INVENTOR(S) : Walton McCarthy

It is certified that error appears in the above-identified patent and that said Letters Patent is hereby corrected as shown below:

| Column | Line | |
|---|---|---|
| 3 | 50 | "develops" should read --develops,-- |
| 4 | 64 | "104" should read --104'-- |
| 8 | 58 | "concentrated" should read --constructed-- |
| 9 | 6 | "walls" should read --wells-- |

Signed and Sealed this

Thirty-first Day of August, 1993

Bruce Lehman

*Attest:*

BRUCE LEHMAN

*Attesting Officer*

*Commissioner of Patents and Trademarks*